US005506761A

United States Patent [19]

Strauss

[11] Patent Number: 5,506,761

[45] Date of Patent: Apr. 9, 1996

[54] LIGHTING FIXTURE AND MODULAR LIGHTING SYSTEM INCORPORATING SAME

[76] Inventor: Gary J. Strauss, 7 Candlewood Knolls Rd., New Fairfield, Conn. 06812

[21] Appl. No.: 203,550

[22] Filed: Mar. 1, 1994

[51] Int. Cl.[6] ..... F21V 29/00

[52] U.S. Cl. ..... 362/267; 362/294; 362/431

[58] Field of Search ..... 439/485, 487, 439/556, 275; 362/294, 373, 378, 267, 368, 306

[56] References Cited

U.S. PATENT DOCUMENTS 4,858,377 8/1989 Carter ..... 248/545
4,882,667 11/1989 Skegin ..... 362/373
4,931,912 6/1990 Kawakami et al. ..... 362/294
5,183,330 2/1993 Rishel et al. ..... 362/372
5,386,356 1/1995 Davis et al. ..... 362/267

*Primary Examiner*—Carroll B. Dority

[57] ABSTRACT

A lighting fixture is provided that is capable of handling light bulbs, which output a relatively high level of heat, such as halogen bulbs, in a base up or base down position. The fixture of the invention can be mounted singly or as an element of a modular lighting system. The fixture comprises a head member, a bulb and socket combination, a heat insulating sleeve comprising a heat resistant gasket, and a lamp holder adapted for supports of the aforesaid elements while providing a convenient location for connecting an external electrical power to the fixture. In the modular embodiment of the invention, the lamp holder is replaced by a modular adapter adapted to facilitate connection and/or removal of individual lighting elements.

4 Claims, 6 Drawing Sheets

LIGHTING FIXTURE AND MODULAR LIGHTING SYSTEM INCORPORATING SAME

FIELD OF THE INVENTION

The invention described herein relates to a novel lighting fixture for both indoor and outdoor use. The fixture is designed to permit either upward or downward mounting of substantially any illumination source, including halogen bulbs providing relatively elevated levels of thermal energy. The fixture is additionally capable of use in a modular lighting system for producing substantially any desired lighting effect.

BACKGROUND OF THE INVENTION

Incandescent light bulbs are well known and commonly utilized in the lighting industry. When the filament inside such a bulb is heated by an electrical current, light is produced in the visible electromagnetic spectrum. As an incandescent bulb matures, however, the material used to form the filament, e.g., tungsten, evaporates. To extend the bulb life, the bulb is thus typically filled with an inert gas, usually nitrogen, argon or krypton, which reduces the rate at which the filament is evaporated.

It is additionally known that the temperature of the filament has a direct bearing upon the life of the bulb and the light efficiency, i.e., the amount of light emitted from the filament (measured in lumens per watts). That is, a higher filament temperature will achieve higher efficacy and whiter light but will reduce the expected bulb life.

The inert gas within the bulb enclosure may optionally be doped with a halogen element, such as iodine, bromine or chlorine to produce a so-called "halogen" light source. The halogen within such bulbs reacts with the tungsten as it evaporates to form a halogen-tungsten gas complex. When this complex comes into contact with the hot filament, it disassociates back into halogen and tungsten and the tungsten is thereafter redeposited onto the tungsten filament, thereby extending the life of the light bulb.

Halogen bulbs possess a further advantage in that they radiate whiter light, i.e., than that produced by incandescent bulbs, with a higher lumen output due to the higher operating temperature of the filament. However, this elevated level of thermal energy can cause damage both to the glass enclosing the filament and to the ceramic base of the bulb, as well as to the electrical circuitry connecting the bulb socket to a power source.

It is additionally known in the art that only about 4–6% of the electricity passing through the filament of a light bulb is converted into visible light, while greater than 90% thereof is converted into heat (with the minimal remainder being converted to ultraviolet light). For example, in the case of a non-halogen, i.e., incandescent, light bulb operating in a "base down", i.e., facing downward (as this term is used in the art) position, the better than 90% heat conversion rate can cause the glass temperature of a 100 watt general service bulb to reach 450° F. (230° C.). In a base up, or upward facing position, the glass temperature of such bulbs reaches only about 225° F. (108° C.). Thus, a bulb in a base down position retains much more heat than a bulb in a base up position, particularly when the bulb is contained within a fixture, since the heat generated by the bulb becomes trapped within the fixture and can thus significantly increase the glass temperature.

Alternatively, in the case of, e.g., a 60 watt halogen bulb, the glass temperature in a base down position can reach 430° F. (220° C.), i.e., almost that of a 100 watt incandescent bulb, when the bulb is contained in a fixture, even though the wattage of the halogen bulb is only slightly more than 50% of that of such an incandescent bulb. Thus, as would be apparent to one of ordinary skill in the art, halogen bulbs rated for even higher wattages, particularly when enclosed within a fixture, would reach temperature levels substantially above those achieved by incandescent bulbs.

Such elevated temperatures pose a substantial risk of damage, however. For example, excessive heat may lead to failure of the cement affixing the glass to the base. Further, a spray of relatively cool water, e.g., from a lawn sprinkler or during a rain storm, may lead to the formation of thermal cracks in the hot glass. In addition, the elevated level of thermal energy thus produced has also been known to damage the circuitry connecting the bulb socket to a source of electrical power.

A need for an improved lighting fixture capable of overcoming the difficulties encountered with the use of prior art fixtures as described above, which may be used in both "base up" and "base down" orientations, with all kinds of illumination sources has thus long been recognized within the lighting industry. This consideration takes on even greater importance when certain sources, such as halogen bulbs which produce a substantial amount of thermal energy, are mounted in surroundings which lead to the build-up of elevated levels of thermal energy, e.g., within an enclosure such as a fixture.

SUMMARY OF THE INVENTION

It is therefore an object of the present invention to provide a fixture whose base, and the electrical circuitry contained therein, is thermally isolated from the heat generated by the bulb.

A further object of the present invention is to provide a lighting fixture that can be operated with relatively high energy illumination sources, such as halogen light bulbs, in either a base up or base down position.

Yet another object of the present invention is to provide a modular lighting system, in which individual light fixtures of the type described herein can be added, removed and/or reoriented as desired with relative ease to obtain substantially any desired lighting effect.

The present invention resolves the difficulties encountered in the prior art as described above by providing a lighting fixture that can safely handle substantially any illumination source, including halogen bulbs capable of producing elevated levels of thermal energy, either in a base up or base down orientation. The fixture of the invention is additionally adaptable, as described below, to permit its use within a modular lighting system with either "low voltage" or "line voltage" electrical systems for, respectively outdoor or indoor use.

The light mounting fixture of the invention comprises, in a first embodiment, an illumination source such as an incandescent bulb, a halogen bulb or an inductive light source, e.g., a sodium or mercury vapor bulb; electrical socket means for energizing the illumination source and means encompassing at least a portion of the illumination source for substantially preventing rearward migration of thermal energy produced by the illumination source toward the energizing means.

The fixture of the invention additionally comprises, at the front end thereof (i.e., where the light exits the fixture) a head member surrounding the illumination source, having a biased hood portion and a rearwardly extending enclosure portion formed integral with the hood. The head member is secured to the fixture by means of a fastener passing through a side wall of the enclosure and thereafter into the means for preventing rearward migration of thermal energy. The bulb is positioned within the head member, adjacent the hood portion, and the thermal energy migration prevention means, also referred to herein as a "heat insulating sleeve", prevents heat generated by the bulb from being transferred rearwardly to the energizing means as described below.

The heat insulating sleeve which, as noted above, encloses at least a rear portion of the illumination source includes a first annular member, comprising a relatively thin metal tube extending substantially the entire length of the sleeve and a gasket fixedly attached to the outside of the first member. The first annular member is relatively thin, i.e., in contrast to the thickness of the second annular member discussed below, to reduce as much as possible, the amount of heat conducted rearwardly through the sleeve toward the energizing means. The gasket is formed from a relatively flexible (i.e., in contrast to the material used to form the first annular member) heat resistant material capable of withstanding temperatures up to about 400° F. The sleeve may further include a second annular member, also preferably formed of metal, formed in the shape of a ring fixedly attached to the outside of the first annular member at a forward end thereof. The second, outer annular member preferably has a thickness greater than that of the first member and serves primarily as a support for the fastener joining the head member to the sleeve.

The fixture described above further comprises a lamp holder configured and adapted for connection with a rear terminal portion of the heat insulating sleeve, which protects the electrical wiring connected to the socket from wear and damage due to ambient environmental conditions. The lamp holder additionally provides bracket means for mounting the fixture upon a support such as a pole, fence or wall, etc.

In another embodiment of the invention, the fixture described above is adapted for use in a modular lighting system. The modular fixture of the invention is similar in many respects to that described above in that it comprises a head member, a bulb and socket combination and a heat insulating sleeve. However, in place of the lamp holder described above, the modular fixture of the invention includes at its rear terminus, either a connector member or an adaptor comprising male or female plug means.

In the first modular embodiment, i.e., including the modular connector, the light fixture is mounted by means of the connector to a fixture support member (described below), whereupon the electrical wiring extending from the socket portion of the fixture is mated and connected to corresponding electrical wiring extending through the fixture support member from an external power source. In the second modular embodiment, a male or a female plug, as the case may be, mounted upon the rear surface of the modular fixture is simply plugged or unplugged as required into a corresponding male or female plug located upon any one of a plurality of fixture supports.

One embodiment of a fixture support for use in mounting the modular lighting fixtures of the invention comprises one or more hollow tubes or trunks which may, for example, be pushed or staked into the ground, or which alternately may be secured to a supporting member such as a fence or the (interior or exterior) wall of a building. In an alternate embodiment one or more of these trunks, i.e., referred to herein as "main" trunks, may further comprise a plurality of secondary trunks branching from the main trunk. Optionally, one or more of these secondary trunks may carry at least one tertiary trunk. The secondary trunks may be fixedly or movably (e.g., on a swivel) connected to the primary trunk while the tertiary trunks, when present, are connected in the same manner to the secondary trunks. Moreover, as noted above, some or all of the trunks may be wired with male or female plugs to facilitate electrical connection between the fixture support members and the correspondingly equipped modular lighting fixtures as described above.

DETAILED DESCRIPTION OF THE PREFERRED EMBODIMENTS

Figure 1:
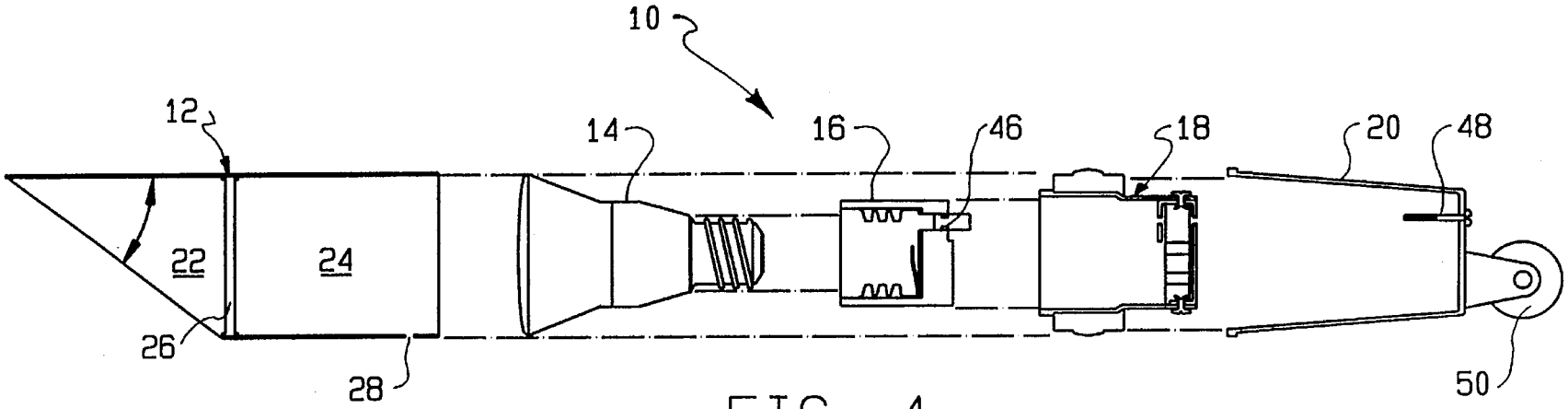
FIG. 1 is an exploded elevation of a lighting fixture constructed according to a first embodiment of the present invention.

Referring now to the drawings wherein like reference numerals are used to designate like parts, and according to FIG. 1, lighting fixture 10 comprises, from front to back, head member 12, illumination source, i.e., bulb 14, socket 16, heat insulating sleeve 18 and lamp holder 20. Illumination sources which may be used with the fixture of the invention include both incandescent and halogen bulbs, and inductive light sources such as high pressure sodium or mercury vapor lamps.

As used herein, the terms "front" and "frontwardly", when applied to the fixture of the invention, refer to that portion of the fixture wherein light exits the fixture. Alternately, the opposed portion or direction is referred to herein as the "rear", or "back" of the fixture.

When fixture 10 is assembled, socket 16 is first secured to sleeve 18 in the manner described below. Thereafter, bulb 14 is screwed into socket 16 and head member 12 is affixed in a manner described below by at least one fastener, such as a bolt, rivet or screw, to heat insulating sleeve 18. The rear portion of sleeve 18 is then inserted into lamp holder 20 where it is held by a friction fit and secured therein by fastening means such as fastener 48 adapted, e.g., for threaded passage through holder 20 and sleeve 18.

Head member 12 of fixture 10 comprises a biased front hood portion 22 configured for directing the light from bulb 14 in any desired direction, and an enclosure portion 24. Biased portion 22 defines an angle, α, at its front end ranging from about 15° to about 90° and preferably between about 45° and 60°.

Enclosure 24 extends rearwardly from hood portion 22 and is formed integrally therewith. Enclosure 24 is preferably in the shape of a cylindrical tube, but may also be configured in some other shape as long as it is understood that bulb 14 must be able to be fit within enclosure 24. Enclosure 24 is adapted as described below to facilitate dissipation of the heat produced by bulb 14, and to prevent the contact of bulb 14 by moisture present in the surrounding environment, i.e., in the form of snow or rain, or water sprayed upon the fixture by hoses or lawn sprinklers.

The open end of head member 12 adjacent to hood portion 22 is closed by shield member 26. Shield member 26 is preferably formed of a clear and heat-resistant thermal glass or plastic to permit light from bulb 14 to pass therethrough. Alternately, shield member 26 may be tinted to impart a color to the light from bulb 14. Shield member 26 is preferably sealed around its periphery with, e.g., any commonly available waterproof, heat-resistant caulking material to prevent entry into fixture 10 of ambient moisture from the surrounding atmosphere.

Head member 12 is further provided, adjacent its open rearward end, with at least one aperture 28 through a side wall of enclosure 24. Aperture(s) 28 is adapted to permit passage of a fastener, such as a screw, for connecting head 12 to heat insulating sleeve 18 as described below.

Figure 1A:
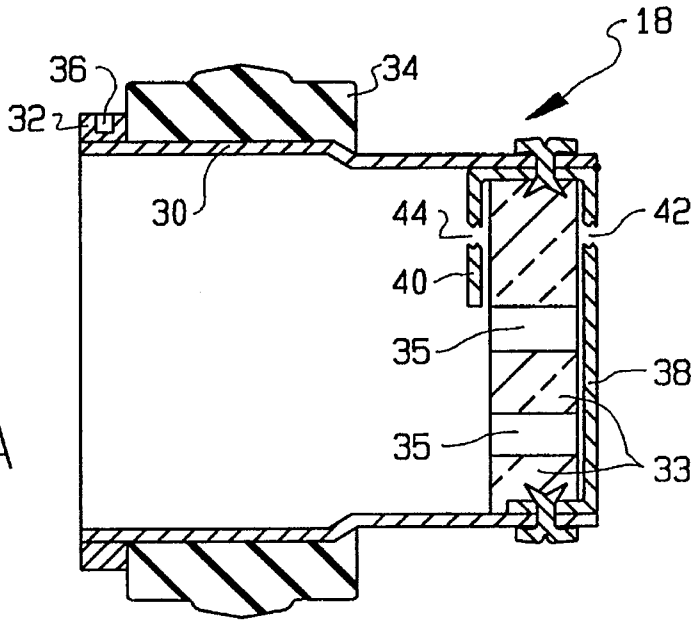
FIG. 1A is a section through one embodiment of a heat insulating sleeve for inclusion in the lighting fixture of FIG. 1.

As shown in FIG. 1A, heat insulating sleeve 18 comprises, from the inside out, a thin inner annular tube member 30, which may be of a substantially constant or a varying diameter and which extends substantially throughout the entire length of heat insulating sleeve 18. In one embodiment annular member 30 may be formed of metal such as copper, aluminum, cast aluminum, steel such as stainless steel, cast iron or wrought iron. The particular metals chosen for use in forming member 30 have relatively high strengths at relatively reduced thicknesses which is necessitated due to the relatively high thermal conductivity of such materials. The preferred thickness for tube member 30 ranges between about 1/64 of an inch to 1/2 of an inch, and a more preferable thickness is 1/32 of an inch to 1/8 of an inch, with the most preferable thickness being about 1/16 of an inch. Due to the minimal thickness of member 30, therefore, sleeve 18 conducts only a minimal amount of heat rearwardly from the bulb 14 toward lamp holder 20.

A variety of alternate materials which are relatively poor conductors of heat may be substituted for the metals described above. For example, annular member 30 could be formed out of teflon based compound. These materials are readily commercially available in various industry grades, e.g., TFE, FEP and PFA, each of which maybe used in the present invention. These materials are sold under trade names such as "Teflon Chemical Tubing" from manufacturers such as Modern Plastics, Inc. in Bridgeport, Conn. and AIN Plastics, Inc. in Mount Vernon, N.Y. The teflon materials described above are able to withstand temperatures up to about 500° F. (260° C.). Still further, another useful material for forming member 30 comprises tubular segments cut from commonly available PVC (polyvinyl chloride) piping.

Sleeve 18 may additionally comprise a second annular member 32 which is at least as thick and preferably substantially thicker than the first, i.e., inner annular member 30. The thickness of outer member 32 may range between about 1–5 times the thickness of inner member 30 and preferably between about 2–4 times its thickness. This second member 32 is preferably configured in the shape of a ring and extends annularly around a forward end portion of sleeve 18 located adjacent to the base of bulb 14 (when bulb 14 is inserted into socket 16). Ring 32 provides support for inner annular member 30, particularly, when member 30 is very thin, e.g. 1/32 of an inch or less, as well as for head member 12 as explained below. In an alternate embodiment, however, when inner member 30 is sufficiently thick and/or has sufficient strength to support head member 12, outer member 32 may be dispensed with entirely. Ring 32, when present is preferably, but not necessarily formed out of the same material as inner annular member 30. Ring 32 defines at least one threaded aperture 36 adapted to permit passage of at least a portion of a fastener such as a threaded screw or bolt for securing head member 12 to sleeve 18.

Head member 12 is affixed to heat insulating sleeve 18 by inserting a fastener, e.g., a threaded screw, through aperture 28 in enclosure 24 and thereafter into a corresponding threaded aperture 36 in ring 32. Aperture 36 may extend either partially or entirely through outer ring 32. If desired, an aperture corresponding to aperture 36 in member 32 may be provided through member 30 to provide an additional gripping surface for the fastener which, in turn provides additional support and stability for head member 12.

Sleeve 18 further comprises a gasket member 34 (which is further described below) and a base member 38 secured thereto (e.g., by rivets) comprising a portion 40 adapted for securing socket 16 to sleeve 18. Further, sleeve 18 may optionally include, particularly when inner 30 and outer 32 annular members are formed out of metal, insulating member 33, which is constructed, in the preferred embodiment, from the teflon material described above for use in forming inner annular member 30. Preferably insulating member 33 (described below) is secured at the rear end of sleeve 18 and is thus positioned between socket 16 and lamp holder 20. Member 33 defines at least one aperture to permit the passage of electrical wiring connecting socket 16 to an external electrical source.

To assemble fixture 10, bulb 14 is inserted into socket 16, typically by means of corresponding threads on the base of bulb 14 and in socket 16. Socket 16 is then connected to securing portion 40 of base member 38 by passing fastener means such as a threaded screw or bolt from the open end of socket 16 through aperture 46 and thereafter through corresponding aperture 44 in portion 40. Bulb 14 is then inserted within head member 12, which is then connected to sleeve 18 by passing a fastener through aperture 28 in enclosure portion 24 of head member 12 and aperture 36 in outer ring 32, or through an aperture defined in inner member 30 when outer member 32 is not present. Thereafter, heat insulating sleeve 18 is connected to lamp holder 20 by passing threaded fastener 48 from holder 20 through threaded aperture 42 defined by the socket securing portion 40 of base member 38.

When assembled, fixture 10 can be mounted onto a support member such as a fence or building wall, by mechanically affixing bracket 50 on lamp holder 20 thereto by a fastener such as a nail or screw and thereafter connecting electrical wiring (not shown) extending from socket 16, through sleeve 18, including insulating member 33 and lamp holder 20 to an external power source, e.g., an electrical socket or a generator.

A novel feature of the present invention is that the heat generated by bulb 14 initially remains within head member 12 rather than migrating rearwardly toward socket 16 due to the insulating effect of gasket 34 (described below). This permits such heat to subsequently be passed by conduction through the air inside enclosure 24 to the outer wall of the enclosure 24, from which it is dissipated by conduction, convection and radiation to the surrounding atmosphere. Head member 12 is preferably constructed of any of the same metals used to form members 30, 32. Alternatively, member 12 can be formed of a plastic, such as "Ultravent" PVC piping. Thus, due to the relative heat dissipating capability of head member 12 versus that of sleeve 18, the thermal energy produced upon operation of illumination source 14 travels forwardly rather than rearwardly within fixture 10, whereupon, as noted above, it is dissipated into the surrounding atmosphere.

Gasket 34 which forms part of heat insulating sleeve 18 is preferably formed from a relatively heat resistant material capable of withstanding temperatures up to about 400° F. (about 200° C.). A preferred material for use in forming gasket 34 is a self-fusing silicon rubber tape. Such tapes are additionally resistant to both water and chemicals and are commercially available from the Merco Company of Hackensack, N.J. and the 3M Company of St. Paul, Minn.

Gasket 34 may be produced, for example, by winding a plurality of turns of the self-fusing silicon tape described above around at least a portion of the outer lateral surface of annular member 32 until a gasket having the desired shape and thickness is achieved. Alternatively, and more preferably, the gasket may instead be formed by molding, e.g., injection molding or die casting a silicon based rubber that has physical characteristics similar to the self-fusing silicon rubber tape described above and then inserting inner annular member 30 therethrough. Gasket 34 may be formed in any desired size or shape to accommodate a variety of fixture sizes and shapes (see, e.g., FIGS. 2A–2D discussed below).

As shown in FIG. 1, bulb 14 is threadedly attached to socket 16, which is formed from a heat insulative material such as ceramic or porcelain, and the socket is in turn inserted into the heat insulating sleeve 18. Thus the air gap between the heated bulb and the electrical circuit contained inside lamp holder 20 is minimal compared to the air gap between the bulb and the wall of head member 12. As would therefore be apparent to one of ordinary skill in the art, only a minimal amount of heat that is not transferred to the head member 12 will pass, i.e., by conduction, toward lamp holder 20. The amount and/or degree of such heat encountered with the use of the fixture of the invention is insufficient, however, to cause any damage to the fixture or its component parts.

Moreover, further to the above, since annular member 30 is relatively thin and is positioned parallel to the direction of heat flow, the heat transfer rearwardly through member 30 is small. This insulating effect is heightened when a relatively poor heat conductor, such as teflon, is used to form member 30. Thus, the amount of heat transferred through the air gap between the bulb 14 and the electrical wiring in lamp holder 20 is substantially less than that transferred through the air gap between the bulb 14 and the wall of head member 12.

In a preferred embodiment, the rearward transfer of such thermal energy can be effectively obviated by the insertion of insulating member 33 within sleeve 18, as shown in FIG. 1A. Insulating member 33 is preferably formed from a heat resistant plastic or rubber compound, e.g., one of the silicon based rubbers or the Teflon based compounds described above.

Additionally, as a further measure for preventing heat damage within fixture 10, the electrical wires connecting socket 16 to an external power source (not shown) may be thermally reinforced with a teflon coating. Such wires are available commercially as so-called "appliance grade wires" which are rated for temperatures of up to about 200° C.

FIGS. 2A–2D illustrate several alternate embodiments of heat insulating sleeve 18. These embodiments are of generally similar construction, but differ, e.g., in size and/or shape and/or the presence or absence of insulating member 33. The embodiments shown and described are for illustrative purposes only and are not intended to limit the invention in any way.

Figure 2A:
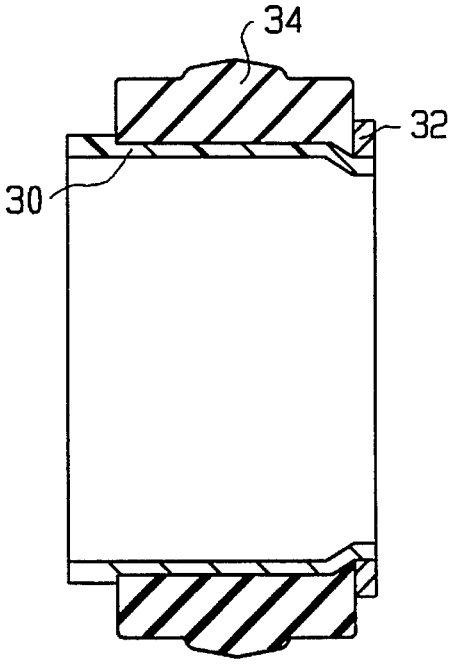
FIGS. 2A–D are sectional views through several additional embodiments of the heat insulating sleeve shown in FIG. 1.
Figure 2B:
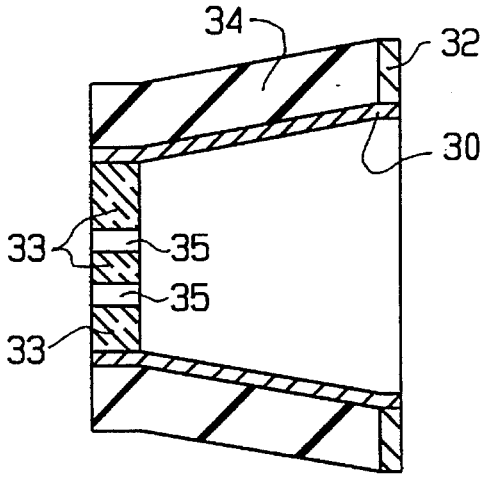
Figure 2C:
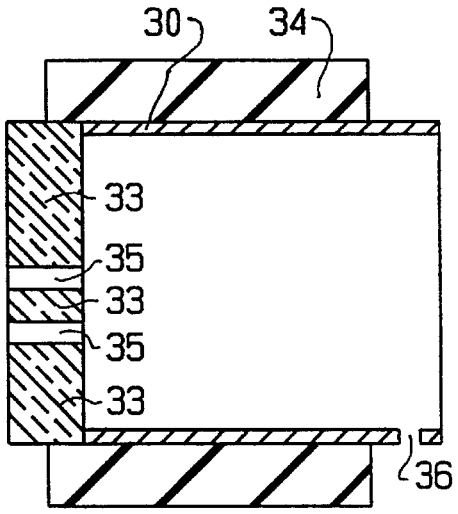

For example, the embodiment of heat insulating sleeve 18 illustrated in FIG. 2A comprises a gasket which varies in thickness throughout its length. The embodiment shown in FIG. 2B comprises a truncated cone shaped gasket 34, inner annular member 30 and ring 32. The embodiment shown in FIG. 2C has a generally cylindrical shape wherein gasket 34 has a constant thickness. Also shown in FIGS. 2B and 2C are two different embodiments of insulating member 33. Insulating member 33 can be fitted within inner annular member 30, as shown in FIG. 2B, or can be positioned in abutting relation to rear portion of inner annular member 30 as shown in FIG. 2C.

Figure 2D:
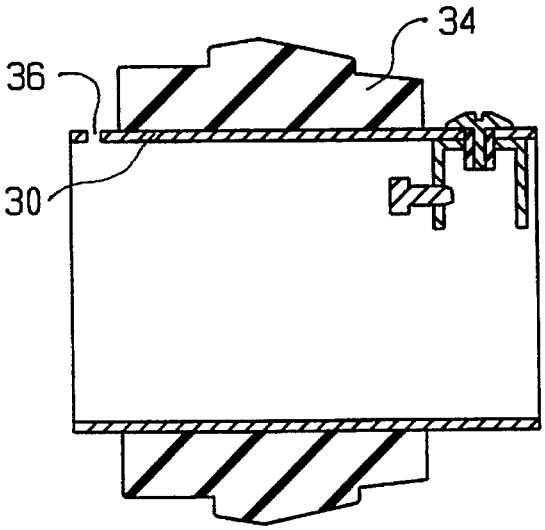

Further to the above, the embodiments of sleeve 18 shown in FIGS. 2C and 2D differ from the other embodiments shown, e.g., in FIGS. 1A, 2A and 2B in that they do not include the second, i.e., outer annular member 32. Thus, the at least one threaded aperture 36 described above for use in securing head member 12 to sleeve 18 in these embodiments is defined by inner member 30 since there is no corresponding outer member 32. The threaded fastener still connects head member 12 to heat insulating sleeve 18, however, in a manner similar to that described above, i.e., through aperture 28 in enclosure 24 and thereafter through aperture 36 in member 30. In embodiments not including member 32, however, it is preferred to utilize an inner member 30 having an increased thickness relative to that utilized in sleeves 18 comprising both first 30 and second 32 annular members since, in such sleeves 18, member 30 provides the sole support for head member 12.

Further, as noted above, outer member 32 or inner member 30 e.g, in the embodiments illustrated in FIGS. 2C and 2D) may define more than one threaded aperture 36. Thus, head member 12 can be mounted on heat insulating sleeve 18 at substantially any angular disposition. That is, fixture 10 can be rotated to any angle between 0°–360° position prior to securing member 12 to sleeve 18 to direct the light therefrom in any desired direction. This can be accomplished by matching aperture 28 in enclosure 24 to any one of a number of threaded apertures 36 and thereafter locking hood portion 22 into position with the use of a fastener. Alternately, sleeve 18 may instead be provided with only a single aperture 36 which corresponds with one of a plurality of apertures 28 in member 12.

Figure 3:
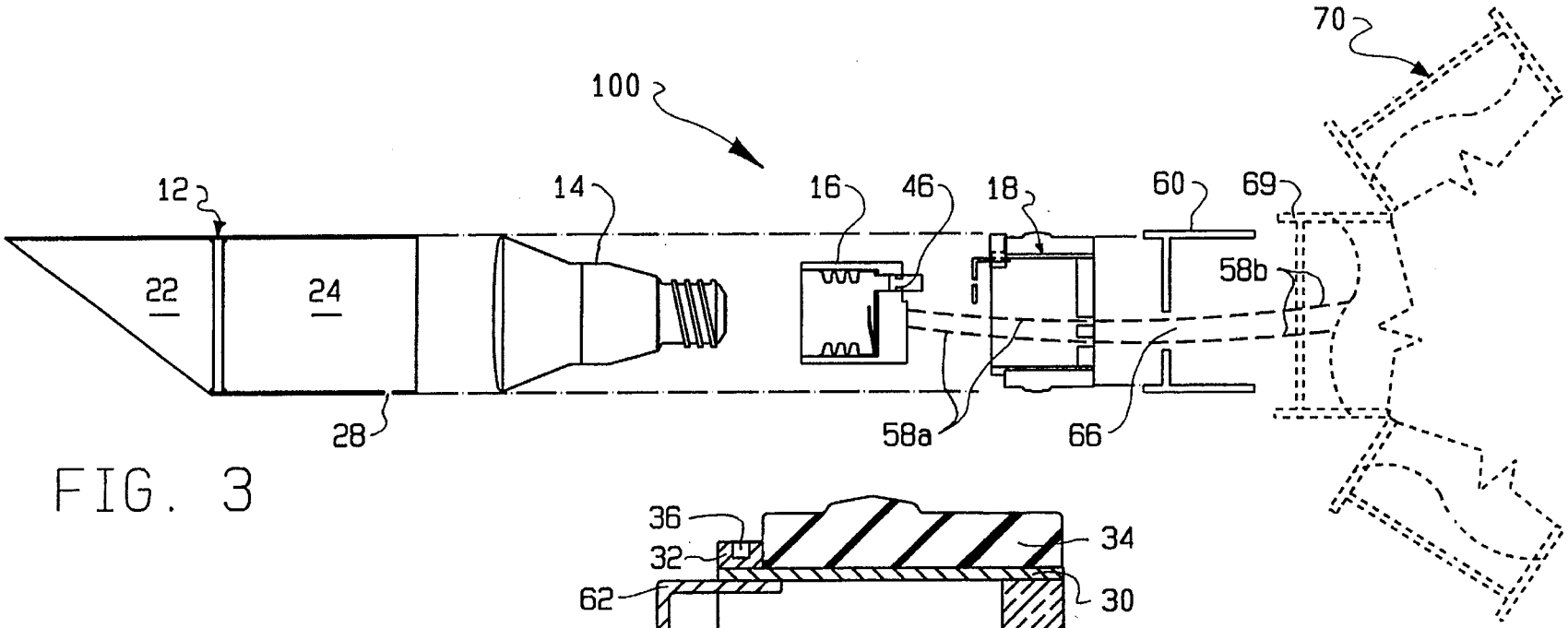
FIG. 3 is an exploded elevation illustrating one embodiment of a modular lighting fixture constructed according to the present invention.

In a further embodiment of the invention, fixture 10 as described above is adapted for use in a modular lighting system as described hereinbelow. One embodiment of such a modular fixture is shown in FIG. 3, which is similar in many respects to light fixture 10. That is, modular fixture 100 also comprises head member 12, illumination source, e.g., light bulb 14, socket 16, and heat insulating sleeve 18. However, in place of lamp holder 20 used with the non-modular embodiment of the fixture 10 illustrated, for example, in FIG. 1, modular fixture 100 further comprises modular connector 60 (described below).

As shown, e.g., in FIG. 3, in the first modular embodiment of the present invention, connector 60 at the rear end of fixture 100 is adapted to fit on to, or alternately into, a support member 69 from which fixture 100 can be easily installed or removed. Support members 69 may be used singularly or may alternately be fused together in arrays 70 comprising a plurality of support members 69. Thus one or more fixtures 100 may be mounted, for example, upon the members 69 of array 70. Array 70 may, if desired, be mounted upon a supporting member such as a pole, for indoor use as, e.g., a pole lamp or for providing outdoor illumination for, e.g., pathways and/or shrubbery. Alternately, arrays 70 may instead be attached upon any available preexisting support, such as a fence or a wall.

Figure 3A:
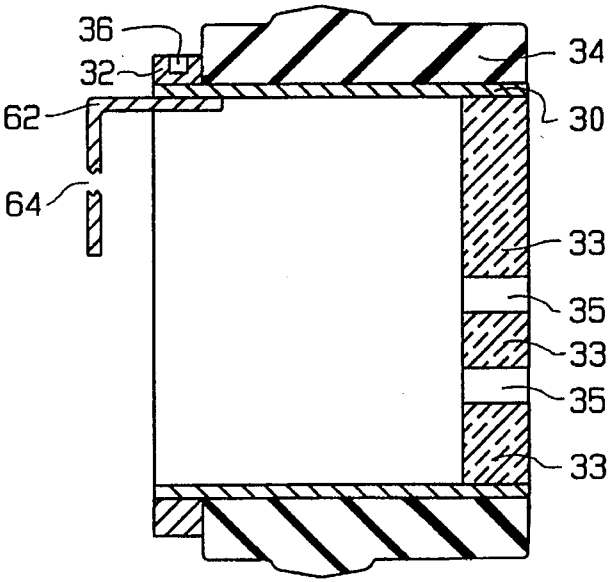
FIG. 3A is a sectional view of a heat insulating sleeve for inclusion in the modular fixture of FIG. 3.

Preferably, however, the heat insulating sleeve 18 of the type illustrated in FIG. 3A is used in the subject modular embodiment. In the subject embodiment, sleeve 18 comprises socket securing member 62 defining aperture 64. Member 62 is formed integral with, or is otherwise attached, e.g., by a fastener, to inner annular member 30 of sleeve 18. In this embodiment, socket 16 is not mounted within sleeve 18, but is instead mounted forwardly of securing member 62 by means of a threaded fastener passing from the open end of the socket through aperture 46 in socket 16 and thereafter through aperture 64 in member 62. Any of the above described embodiments of sleeve 18 shown in FIGS. 1A and 2A–2D can also be used with modular fixture 100.

In the embodiment shown in FIGS. 3 and 3A, fixture 100 is energized in the following manner. Electrical wires 58A pass from socket 16 through sleeve 18 via the at least one aperture 35 defined by insulating member 33 and thereafter through aperture 66 defined in connector 60. Wires 58A are connected, e.g., by twisting together, with corresponding wires 58B extending through support member 69 from an external power source. Thus, a support member 69 or array 70 serves several functions, i.e., it supports the fixture 100, while providing a point of attachment for electrical wires 58A and 58B. This wiring is additionally protected from the elements and hidden from sight within member 69 or array 70.

Figure 4:
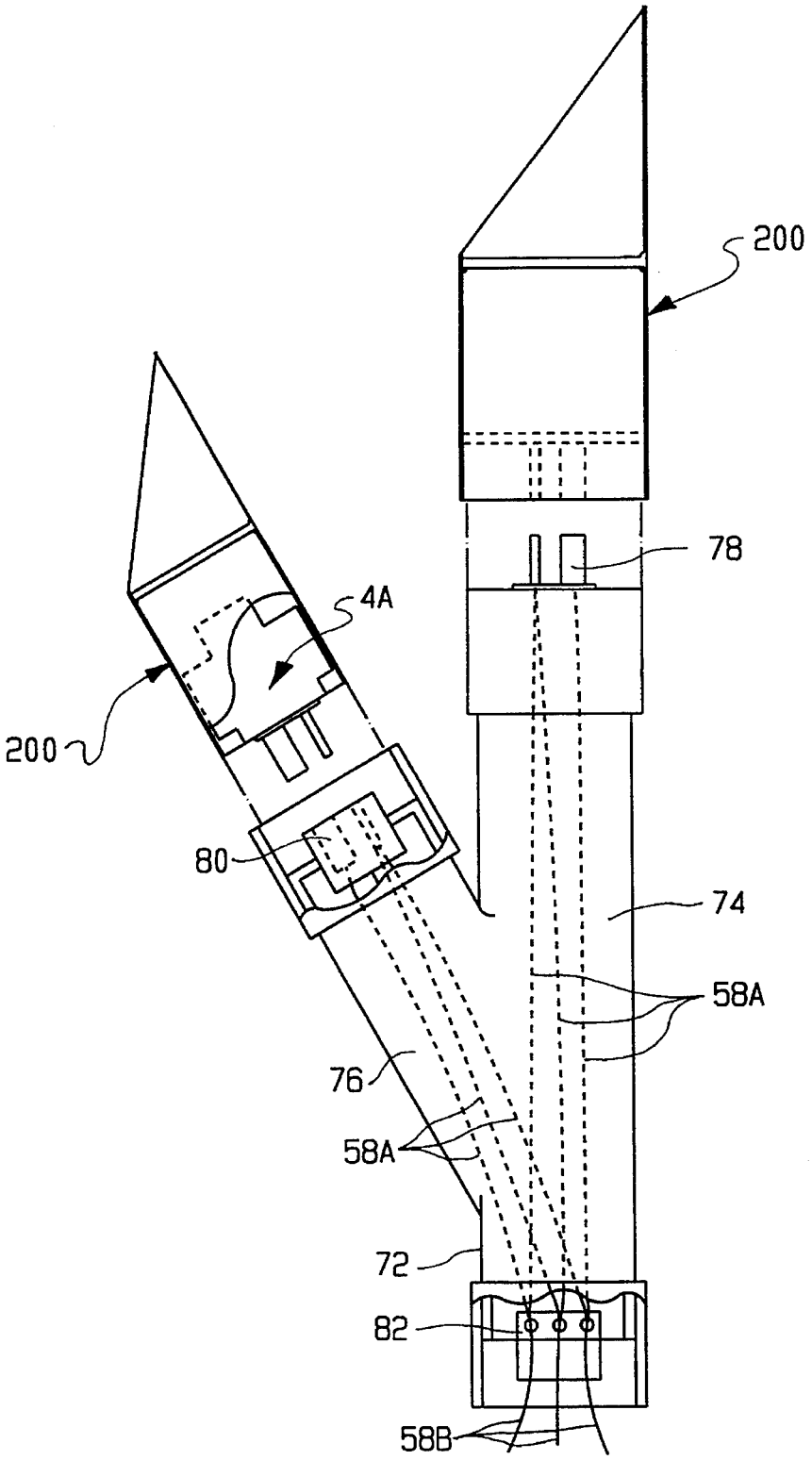
FIG. 4 is an exploded elevation of an alternate embodiment of a modular lighting fixture as used within a modular lighting system according to the present invention.
Figure 4A:
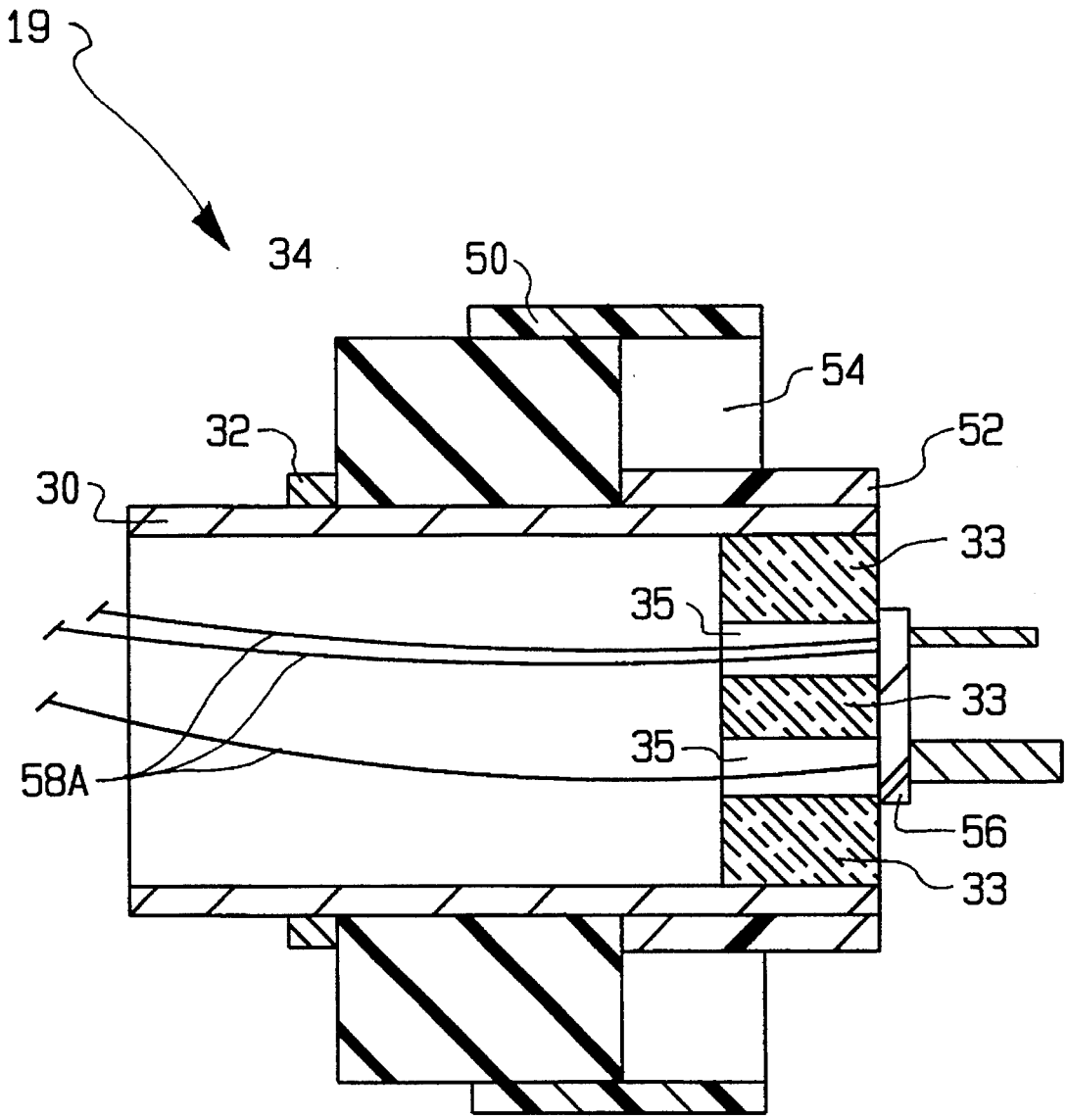
FIG. 4A is a sectional view through an alternate embodiment of a heat insulating sleeve for use with the modular lighting fixtures shown in FIG. 4.

Turning now to FIGS. 4 and 4A, there is illustrated an alternate modular embodiment of the fixture 200 of the invention which is further described below. The modular system shown in FIG. 4 comprises main trunk 72 and at least one secondary trunk. While two secondary trunks 74 and 76 are shown, it should be understood that main trunk 72 can carry any number of such trunks, either fixedly or movably mounted (e.g., by a swivel mount permitting a limited degree of transverse movement). The secondary trunks may optionally be provided with one or more tertiary trunks extending therefrom as shown, for example in FIG. 5, wherein tertiary trunk 84 is shown branching off of secondary trunk 86.

Figure 5:
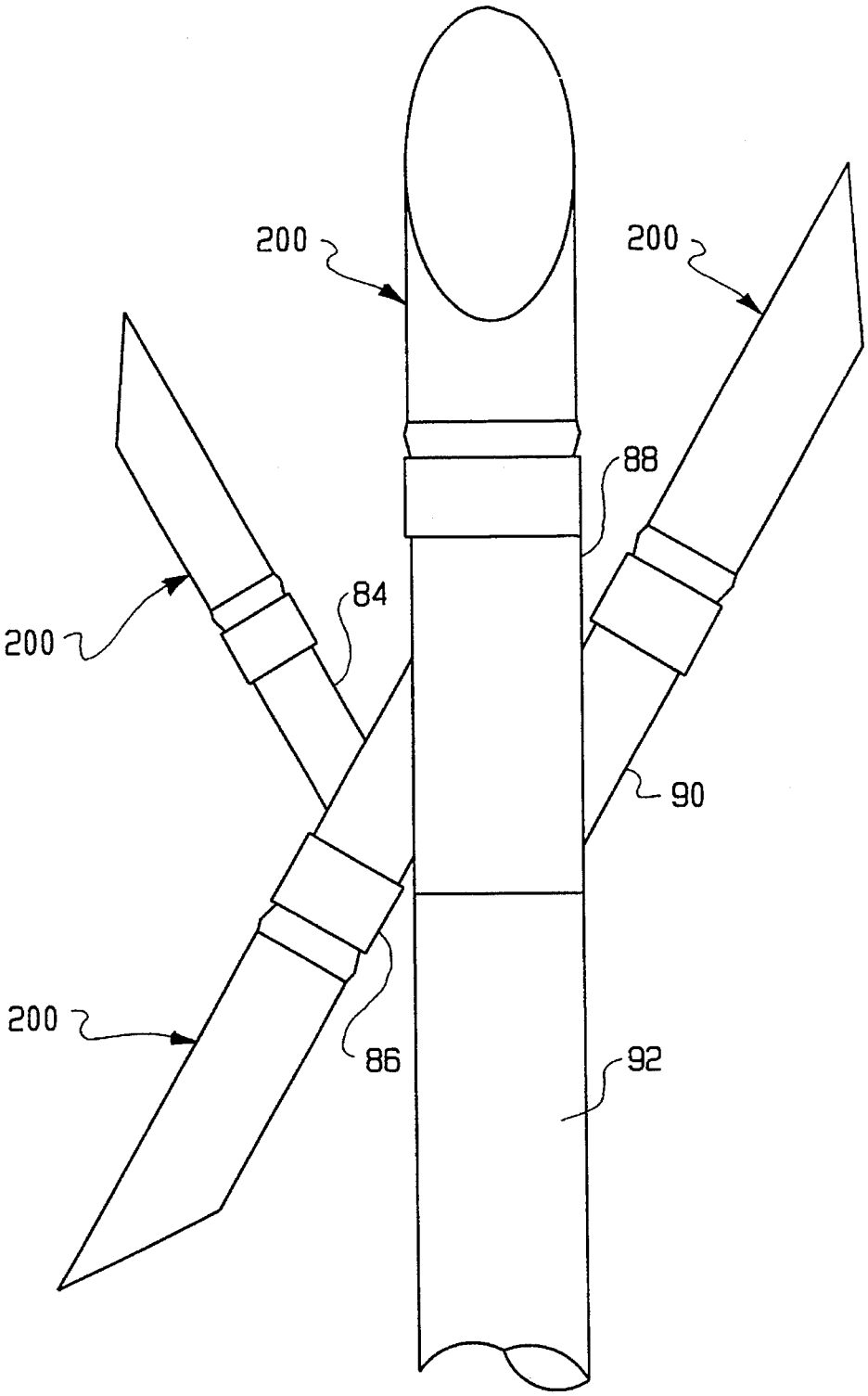
FIG. 5 is an elevation of an alternate embodiment of the modular lighting system shown in FIG. 4.

FIG. 5 shows one illustrative example embodiment a modular lighting system utilizing the comprising one primary trunk 92 along with three secondary trunks 86, 88, 90 of varying sizes, two of which (88, 90) point upwardly with the fixture 200 in a base up position, while the third 86 points downwardly with fixture 200 oriented in a base down position.

Returning to FIG. 4, secondary trunk 74 comprises male plug 78 while secondary trunk 76 carries female plug 80. As would be apparent to one skilled in the art, modular fixture 200 may be provided with either a male or a female plug when used in conjunction with the modular system in the invention. As also shown in FIG. 4, electrical wires connect all of the plugs to main switch 82, which is, in turn, electrically connected to a power source.

In FIG. 4A there is illustrated an adapter 19 for use with the modular lighting system illustrated in FIGS. 4 and 5. Adapter 19 essentially replaces the combination of sleeve 18 and modular connector 60 utilized in the first modular embodiment illustrated in FIG. 3. As shown in FIG. 4A, in addition to gasket 34, insulating member 33 and inner annular member 30 and outer annular member 32, adapter 19 has an annulus 54 (also referred to in the art as a "saddle" or a "sleeve") defined by concentric outer ring 50 and inner ring 52 adapted for gripping an upper portion of a modular fixture support member 69.

Also shown in FIG. 4A is male plug 56 mounted upon insulating member 33 and connected by wires 58A to socket 16. Plug 56 is designed to permit fixture 100 to simply be plugged directly into an electrical outlet or similar power source as shown for example in FIG. 4. It should also be noted that plugs, male or female, can be fitted onto members 69 of array 70 to permit the use of adapter 19 in conjunction with array 70.

Adapters 19 for use with modular system illustrated in FIGS. 4 and 5 may be configured in a variety of different ways. As shown in FIG. 4, for example, secondary trunk 74 is mated with a modular fixture 200 that will fit over the plug at the end of trunk 74, while secondary trunk 76 is mated with another modular fixture 200 that will fit into the plug at the end of trunk 76. Thus the modular systems of the present invention possesses a great deal of flexibility.

The secondary and tertiary trunks of the subject modular system can be any desired length or diameter. Further, secondary trunks can form any angle between about 30°–150° with main trunks 72, 92 as shown, respectively, in FIGS. 4 and 5. Similarly, the tertiary trunks can form any angle between about 30°–150° with the secondary trunks as shown in FIG. 5. Additionally, the secondary and tertiary trunks may be substantially straight, or they may be twisted or bent into any desired angle or shape.

For outdoor use, the external portions of lighting systems using the modular lighting fixture of the present invention should be constructed of a material which is relatively inexpensive and which is not adversely affected by environmental factors such as heat, cold and precipitation. Specifically, the array 70 including members 69 and modular connectors 60 can be made out of a variety of materials such as porcelain, and plastics such as polyvinyl chloride, melamine and bakelite. Additional classes of materials can also be used as long as they possess adequate strength and can insulate the internal electrical circuitry from the environment.

A further advantage of the fixtures of the present invention is that they may be used with "low voltage" power sources, e.g., in outdoor use. As one of ordinary skill in this field would know, such sources generate 12 volts of potential difference by the use of a step down transformer from ordinary "line voltage" which is typically 120 volts. Alternatively, however, these fixtures are just as capable of use, e.g., in interior lighting applications, with line voltage power sources as defined above.

While several embodiments of the present invention are described herein, it would be understood by one of ordinary skill in the art that the various features of the several embodiments described herein can be used singly or in a variety of combinations depending upon the desired application. Therefore, this invention is not to be limited only to the embodiments specifically described herein, but instead it is considered to include all those embodiments falling within the scope of the appended claims.

I claim:

1. A lighting fixture comprising: a cylindrical enclosure being open at one end and having a glass or plastic closure at an opposite end; a heat insulating member inserted in said one open end to close such; said heat insulating member including a relatively thin tubular member surrounded by a gasket member, said cylindrical enclosure being forced fitted on said gasket member, one end of said tubular member including a closure means, a socket for a lamp inserted in a opposite end of said tubular member and fastened to said closure means, insulating means being located between said lamp socket and said closure means.

2. The light fixture of claim 1 further comprising; a hood on said cylindrical enclosure adjacent said glass or plastic closure.

3. The lighting fixture of claim 1 further comprising; a lamp holder attached to said tubular member closure means.

4. The lighting fixture of claim 1 further comprising; fastener means attaching said cylindrical enclosure to said heat insulating member.

* * * * *